United States Patent [19]

Christen

[11] 4,358,171

[45] Nov. 9, 1982

[54] INSTALLATION COMPRISING AN ICE-BOX FOR A HOTEL ROOM

[75] Inventor: Jean-Louis Christen, Geneva, Switzerland

[73] Assignee: Societe pour l'Exploitation de l'Hotel du Rhone, Geneva, Switzerland

[21] Appl. No.: 153,499

[22] Filed: May 27, 1980

[30] Foreign Application Priority Data

Jun. 1, 1979 [CH] Switzerland ..... 5135/79

[51] Int. Cl.[3] ..... A47B 46/00

[52] U.S. Cl. ..... 312/286; 312/305; 232/43.3

[58] Field of Search ..... 312/286, 287, 289, 305; 232/43.3; 109/19

[56] References Cited

U.S. PATENT DOCUMENTS

| | | | |
|---|---|---|---|
| 841,405 | 1/1907 | Jewell | 312/289 |
| 1,237,375 | 8/1917 | Parks | 312/286 |
| 1,653,530 | 12/1927 | Abrachinsky | 312/286 |
| 1,784,743 | 12/1930 | Montgomery | 232/43.3 |
| 1,935,130 | 11/1933 | Schauman | 312/286 |
| 2,703,200 | 3/1955 | Burbank | 232/43.3 |
| 2,885,144 | 5/1959 | Smithers | 232/43.3 |
| 3,077,243 | 2/1963 | Buros | 109/19 |
| 3,285,685 | 11/1966 | Hewett | 312/287 |
| 3,807,826 | 4/1974 | Peckenpaugh | 312/305 |
| 3,868,157 | 2/1975 | Robinson | 312/305 |

FOREIGN PATENT DOCUMENTS

| | | | |
|---|---|---|---|
| 251434 | 5/1926 | United Kingdom | 312/286 |

*Primary Examiner*—Victor N. Sakran

*Attorney, Agent, or Firm*—Silverman, Cass & Singer, Ltd.

[57] ABSTRACT

An installation for an hotel room has a frame carrying two ice-boxes which are disposed one above the other, in a head-to-foot arrangement. The frame is slidably supported for movement to a drawn out position in which it is located in a corridor giving access to two adjoining hotel rooms, thus allowing the responsible hotel staff to check the contents of the ice-boxes and, if necessary, to restock them. The frame can be moved away from the corridor into a chest situated at the wall separating the two adjoining rooms and which is provided with apertures situated at the levels of the doors of the two ice-boxes. These apertures allow the occupants of each of the two rooms to gain access, respectively, to the two ice-boxes.

7 Claims, 4 Drawing Figures

INSTALLATION COMPRISING AN ICE-BOX FOR A HOTEL ROOM

BACKGROUND OF THE INVENTION

1. Field of the Invention

This invention relates to an installation comprising an ice-box for an hotel room.

2. Description of the Prior Art

The practice of providing hotel rooms with a mini-bar is now commonplace. Such mini-bars, constituted by a small ice-box which is sometimes accompanied by a non-refrigerated compartment, need their contents to be checked very regularly and to be restocked by the hotel staff which can be a nuisance to the hotel guests occupying the rooms. Because the rooms are not continuously accessible to the staff when they are occupied, it is not possible for an employee to perform, in one routine circuit, the checking and restocking of all the installations for which he is responsible.

It has already been suggested, to overcome this difficulty, that a mini-bar should be rotatably mounted so that it can be turned to bring its door to a position opposite to an opening provided in a wall separating the room from a corridor of the hotel, thus enabling the responsible employee to reach the mini-bar from the corridor.

Such installations, however, are relatively complicated and the operation thereof is not reliable.

SUMMARY OF THE INVENTION

The object of the present invention is to overcome the foregoing difficulties.

The various features of the invention will be apparent from the following description, drawing and claims, the scope of the invention not being limited to the drawing itself as the drawing is only for the purpose of illustrating a way in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENT

The installation illustrated is intended for the fitting out of two adjoining hotel rooms, designated generally by references 1 and 2 respectively, which are separated from each other by a wall 3. These two rooms are separated from a corridor 4, by which they are both served, by a wall 5.

Figure 3:
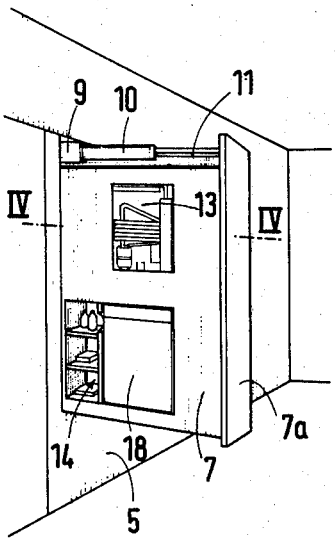
FIG. 3 is a perspective view of the same installation, but from a corridor serving the room.
Figure 4:
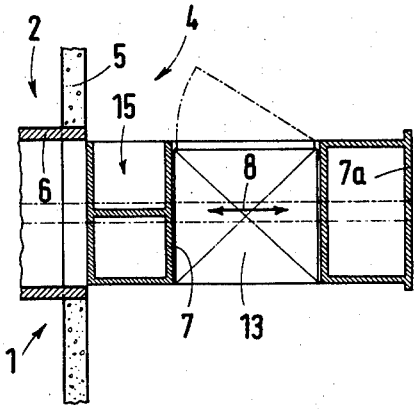
FIG. 4 is a horizontal cross-sectional view of the installation, on the line IV—IV of FIG. 3 but to a larger scale.

The wall 3 is interrupted at a distance from the wall 5, the interrupted portion being occupied by a stationary chest 6 which is accessible at an opening provided in the wall 5, in line with the wall 3, this chest thus opening into the corridor 4. A movable frame 7 is located in the chest 6 and can move in the direction of the arrows 8 (FIGS. 2 and 4), being suspended from a stationary rail 9 (FIG. 3) by means of an intermediate element 10 in which is engaged on a rail 11 rigidly secured to the frame 7. This assembly effects telescopic displacement as a result of which the frame can move to an overhanging position with respect to the rail 9 and be located almost entirely in the corridor 4 (FIGS. 3 and 4). It occupies a similarly overhanging position, but at the opposite inner end of the rail 9, when in its normal position fully engaged in the chest 6.

The frame 7 carries, disposed one above the other and in head-to-foot arrangement, two ice-boxes 12 and 13 the doors of which are located on the side faces of the frame 7 so that one is presented to the room 1 and the other is presented to the room 2. These ice-boxes are of small size and are accompanied, respectively, by a non-refrigerated compartment 14 opening to the room 1 and by a non-refrigerated compartment 15 opening to the room 2. The side walls of the chest are provided, in each room, with an opening 16 exposing the door of one of the ice-boxes and the corresponding compartment when the movable frame 7 occupies the normal position shown in FIGS. 1 and 2. These openings 16 are provided with lockable doors 17 one of which, i.e. that of the room 1, is shown in the drawing in the open position, and these doors enable the room access to the ice-boxes and to the compartments to be blocked off. The door of one of the ice-boxes, designated by reference 18, is shown in FIG. 1 where it has been shown in the open position.

The chest 6 serves also as an air duct for the cooling of the heat-exchange elements of the ice-boxes and is provided, for this purpose, with openings 19 fitted with louvers.

Figure 1:
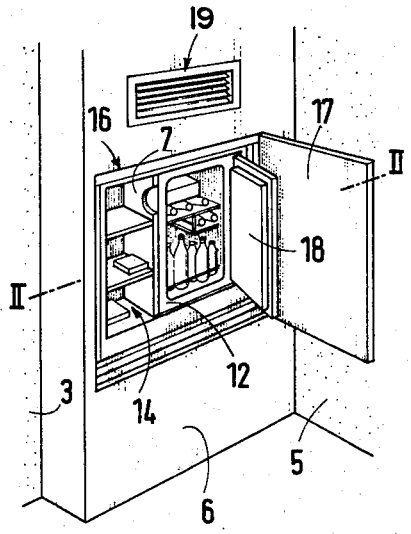
FIG. 1 is a perspective view, from the inside of an hotel room, of an installation comprising an ice-box, constructed and arranged in accordance with the invention.
Figure 2:
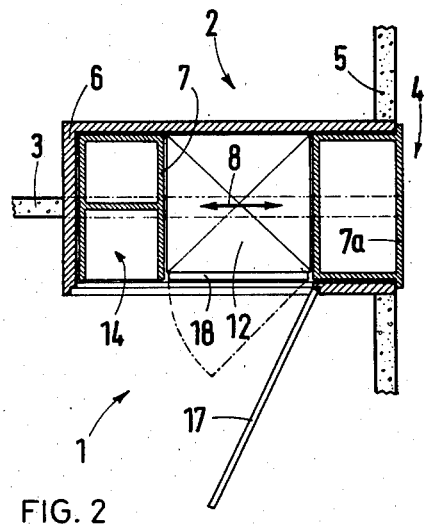
FIG. 2 is a horizontal cross-sectional view of this installation, on the line II—II of FIG. 1 but to a larger scale.

When the movable frame 7 occupies the normal position represented in FIGS. 1 and 2, in which it is located in the chest 6, the occupants of the rooms 1 and 2 can gain access to the ice-box 12 and the compartment 14 as well as to the ice-box 13 and the compartment 15, respectively.

When the contents of the ice-boxes and of the compartments have to be checked, and if required restocked, the hotel staff member concerned does not need to enter the rooms. It is in fact sufficient, while he is in the corridor, for him to draw out the frame 7 from the chest 6 so that he is able to gain access to the two ice-boxes and to the two compartments. A front face **7*a* of the movable frame 7 is preferably provided with a lock to prevent a person who does not have the key from drawing out, from the corridor 4**, the movable frame and thus gaining unauthorized access to the ice-boxes and to the compartments.

The present arrangement is, at the same time, both very simple in construction and reliable in operation.

I claim:

1. An installation for a hotel room with a wall separating the room from an adjoining management space, said room being one of two adjoining rooms and there being a separating wall between the two adjoining rooms, said installation comprising:

a movable frame disposed at an opening provided in said wall separating the room from an adjoining management space and in line with said separating wall, the frame carrying two ice-boxes which are disposed in head-to-foot arrangement, said ice-boxes having doors which respectively open on the two opposite sides of the frame, said frame being slidably arranged so that it can be located, at least partially, on either side of said wall separating the room from an adjoining management space so that when the frame is situated inwardly with respect to the rooms, one of said ice-boxes is accessible from one of the rooms and the other of said ice-boxes is accessible from the other of the rooms and when said frame is located on the other side of said wall separating the room from a management space, both of the ice-boxes are accessible from the management space.

2. An installation according to claim 1, further including a chest situated in the room and within which said frame moves, said chest having a side aperture and one of said ice-boxes having a door which is situated opposite said chest side aperture when said frame is fully engaged in the chest.

3. An installation according to claim 2, wherein said side aperture of said chest is provided with a door which can be locked, in the room, to control access to said ice-box.

4. An installation according to claim 1, wherein a stationary rail extends perpendicularly to said wall separating the room from the adjoining management space, and said frame is suspended from said rail.

5. An installation according to claim 4, including an intermediate element by which said frame is suspended from said stationary rail, said intermediate element providing for the frame, by telescopic relative displacement of the engaged suspension elements, to move to an overhanging position with respect to said stationary rail when it occupies either one of its two extreme positions, either in the room or in the adjoining management space.

6. An installation according to claim 1, wherein said two ice-boxes are situated one above the other.

7. An installation according to claim 1, wherein said management space is a corridor serving for access to both of said two rooms.

* * * * *